United States Patent [19]

Hickling

[11] 4,112,406

[45] Sep. 5, 1978

[54] DUPLEX THERMOSTAT

[75] Inventor: Colin D. Hickling, Woodstock, N.Y.

[73] Assignee: American Thermostat Corporation, South Cairo, N.Y.

[21] Appl. No.: 784,555

[22] Filed: Apr. 4, 1977

[51] Int. Cl.[2] ..... H01H 37/52

[52] U.S. Cl. ..... 337/338; 337/340; 337/364

[58] Field of Search ..... 337/337, 338, 340, 349, 337/360, 361, 363, 364

[56] References Cited

U.S. PATENT DOCUMENTS

| | | | |
|---|---|---|---|
| 2,930,874 | 3/1960 | Andrews | 337/361 |
| 3,223,807 | 12/1965 | Grahl | 337/338 |
| 3,254,184 | 5/1966 | Huffman et al. | 337/363 |

*Primary Examiner*—George Harris
*Attorney, Agent, or Firm*—James & Franklin

[57] ABSTRACT

A thermostat is provided for controlling a heating apparatus having two individually actuatable heating elements in order to more accurately control the heat output of the apparatus. The thermostat is designed such that at environment of temperatures below a set temperature $t_1$, less than the desired temperature t, both heating elements are actuated. As the environmental temperature increases beyond the set temperature $t_1$, the thermostat deactuates the main heating element and the secondary heating element alone is controlled to regulate variations in environmental temperature around the desired temperature level t. Both thermostatic functions are combined in a single device. Means are provided for adjusting the desired temperature level t and the set temperature $t_1$ simultaneously for maintaining the difference $\Delta$ t therebetween at a constant magnitude. Further, means are also provided for adjusting the difference $\Delta$ t between the set temperature t, and the desired temperature level $t_1$. The result is energy conservation and a more stable environmental temperature.

10 Claims, 8 Drawing Figures

DUPLEX THERMOSTAT

BACKGROUND ON THE INVENTION

The present invention relates to heating apparatus control devices and more particularly, to a duplex thermostat designed for use with a heating apparatus having two individually actuatable heating elements.

Thermostatic control devices of a variety of different configurations have long been known and used in the art to regulate heat producing apparatus. Such thermostats normally comprise a pair of relatively movable contracts which are electrically connected to make and break the energization circuit for the heating element or elements of heat producing apparatus. One of the contracts is operatively connected to a thermally deformable element, often in the form of a bimetallic strip, which deforms to move the contacts into engagement when the environmental or sensed temperature reaches a predetermined level. Some method is normally provided for setting and adjusting the desired temperature level. One simple method of accomplishing this result is by varying the distance between the contacts such that more or less deformation of the bimetallic strip is required before the contacts engage.

A conventional thermostat, as described above, has a significant disadvantage when utilized to control the actuation of a conventional heat producing apparatus. When the heating element or elements are initially energized, the environmental temperature rises rapidly towards the desired level. When the desired level is reached, the heat producing elements are deactuated. However, because of the nature of such a system, the environmental tempera- continues to rise significantly above the desired temperature, thereby initially "overshooting" its mark. As the environmental temperature decreases past the desired temperature level, the thermostat will again actuate the heating elements. However, before the environmental temperature begins to rise, it will decrease to a level somewhat below the desired temperature level, thereby "undershooting" the mark. Because there is a significant time lapse or lag between the time when the thermostat actuates (or deactuates) the heating apparatus and the time when the environmental temperature rises (or decreases) significantly, the environmental temperature will continually alternatively overshoot and undershoot the desired temperature level. The initial overshoot will be the largest, and the amplitude of the deviation will, after a few cycles, become substantially constant as the system enters a steady state condition. Thus, as time goes on, the environmental temperature will alternate cyclically around the desired temperature level. The amplitude of this cyclical differential between the environmental temperature and the desired temperature level, is significant, not only from the viewpoint of the comfort of individuals in the environment, but also from an energy conservation standpoint because a system with large cyclical variations requires more energy than necessary to control the environmental temperature.

It is, therefore, a prime object of the present invention to provide a duplex thermostat which, in conjunction with a two-element heat producing apparatus, is capable of significantly reducing the amplitude of the steady state cyclical variations of the environmental temperatures with respect to the desired temperature level.

It is another object of the present invention to provide a duplex thermostat which, in conjunction with a two-element heat producing apparatus, is capable of significantly reducing the initial overshoot of the environmental temperature with respect to the desired temperature when the heat producing apparatus is energized.

It is another object of the present invention to provide a duplex thermostat which is usable in conjunction with a two-element heating producing apparatus wherein the temperature difference $\Delta t$ between the levels at which the respective heating elements are actuated can be adjusted and the entire device can be calibrated to set the desired temperature level.

It is still another object of the present invention to provide a duplex thermostat wherein the two thermostatic functions are combined into a single device which can be manufactured at a minimal cost.

It is still another object of the present invention to provide a duplex thermostat which consists of simple and inexpensive parts which function together reliably to perform the desired result.

In accordance with the present invention, a thermostat is provided, including a support to which first and second resilient members are mounted in spaced relation. Each of the members has mounted thereon a pair of contacts. Each of the contacts on one of the members is aligned with a different contact on the other member. A thermally deformable element, preferably in the form of a bimetallic strip, is mounted on the support at a point spaced from the first member. Means are provided which operably connect the deformable element with the first member such that deformation of the element moves the first member relative to the second member. Means are provided for adjustably positioning the second member relative to the first member in order to permit setting of the desired temperature level $t$.

The first member is formed of first and second electrically isolated parts, upon each of which is mounted one of the contacts. The second member, and thus the contacts carried thereby, are operatively connected to a circuit containing a source of energization for the heat producing apparatus. Each of the first and second isolated parts, which make up the first member, are operatively connected to a different one of different heating capacity heating elements. Thus, the heating elements are independently actuated when the contacts situated on the first member are respectively engaged with the aligned contacts on the second member. The means which connects the first member with the deformable element comprises individual means for spacing the first and second parts of the first member, respectively, different distances from the deformable element. Thus, the thermostat can be calibrated such that the heating elements will be actuated respectively at different degrees of deformation of the thermally deformable element.

The spacing means between the deformation element and first means takes the form of a pair of abutments mounted on the thermally deformable element. Preferably, at least one of the abutments is position adjustable with respect to the thermally deformable element, such that the difference in the degree of deformation of the thermally deformable element (and thus the difference in the respective temperatures at which the heating elements are actuated) required to cause engagement of the aligned sets of contacts, respectively, is also adjustable.

The result of this configuration is that the initial overshoot in the environmental temperature with respect to the set temperature level is substantially eliminated.

Further, the amplitude of the steady state cylical variations of the environmental temperature around the desired temperature level is substantially reduced. Thus, the environmental temperature stays much closer to the desired temperature level than is possible with a conventional thermostat. Moreover, since intial overshoot is virtually eliminated and the amplitude of the cyclical variations in environmental temperature, as compared to the desired temperature level, is reduced, a conservation of energy resultss To these and other objects which may hereinafter appear, the present invention relates to a duplex thermostat as described in the specification and set forth in the annexed claims, taken together with the accompanying drawings, where like numerals refer to like parts and in which:

Figure 1:
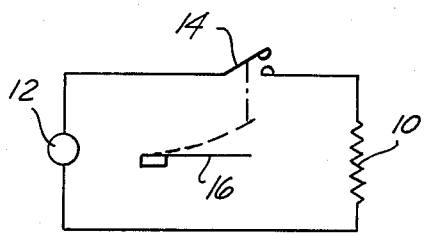
FIG. 1 PRIOR ART
FIG. 1 is a schematic representation of a single element heat producing apparatus as controlled by a conventional thermostat.

FIG. 1 is a schematic representation of a single element heat producing apparatus controlled by a conventional thermostat. Heating element 10, is shown here as an electrically energized resistive heating element, is connected to an energization source 12 through a conventional thermostat comprising switch 14, the contacts of which are opened and closed in response to the deformation of a thermally deformable element 16 to which switch 14 is operatively connected. Element 16 normally takes the form of a bimetallic strip, of the type which is well known in the art.

Figure 2:
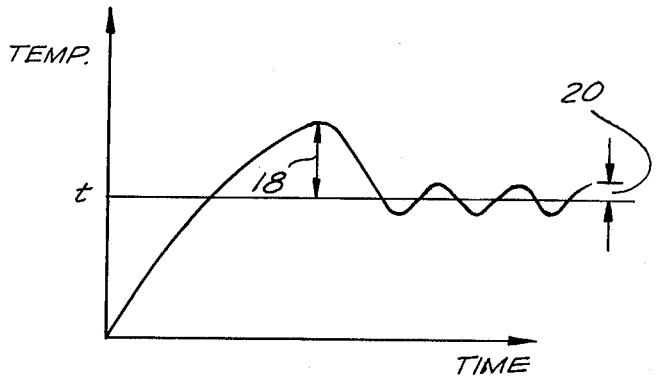
FIG. 2 PRIOR ART
FIG. 2 is a graphical representation of the environmental temperature levels through time produced by the heat producing apparatus of FIG. 1.

FIG. 2 is a graphical representation of the environmental temperature, plotted with respect to time, which will result from te use of heating element 10 of FIG. 1. As is illustrated in FIG. 2, when heating element 10 is initially energized by the closing of the contacts of switch 14, the environmental temperature rises rapidly to a level which is significantly above the desired temperature level *t*. The magnitude of this environmental temperature "overshoot" is shown on FIG. 2 by arrow 18. After the initial temperature overshoot, the environmental temperature will enter into a steady state condition and cyclically vary around the desired temperature level by an amplitude a which is depicted on the graph by arrow 20. These cyclical variations will continue throughout time at approximately the same amplitude until the system is turned off. The initial environmental temperature overshoot and the cyclical variations of the environmental temperature around the desired temperature level are inherent in a system such as that schematically depicted in FIG. 1. These variations do not reflect inaccuracies in the thermostat, but merely time lags which, under normal conditions, cannot be eliminated from the system.

Figure 3:
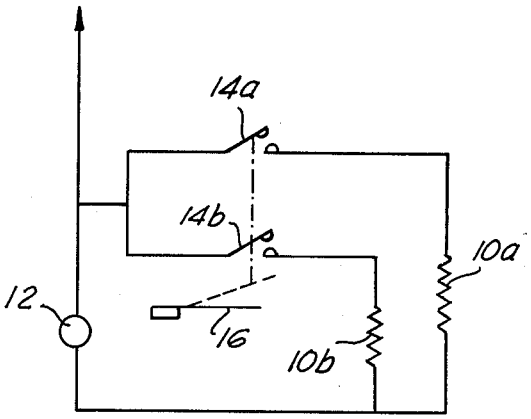
FIG. 3 is a schematic representation of a two-element heat producing apparatus controlled by the thermostat of the present invention.

FIG. 3 schematically represents a double-element heat producing apparatus utilized in conjunction with the duplex thermostat of the present invention. In this system, the main heating element **10*a* and the secondary heating element 10*b* having less heat producing capability are each connected to the energization source 12 through the thermostat comprising separate switches 14*a* and 14*b*, each having a pair of movable contacts. Each of the switches 14*a* and 14*b* are operatively connected to the thermally deformable element 16, preferably in the form of a conventional bimetallic strip, in such a manner as to permit heating elements 10*a* and 10*b*** to be energized independently.

More specifically, switches **14*a* and 14*b* are connected to element 16 in such a way that different degrees of deformation of element 16 are required to close the respective sets of contacts. Further, the different degrees of deformation of element 16 which are required to close switches 14*a* and 14*b*** are relatively adjustable such that, upon turning on the system, as the environmental temperature exceeds a temperature $t_1$, below the desired temperature level *t*, the main heating element **10*a* can be deactuated and the secondary heating element 10*b*** utilized to control the environmental temperature. Of course, as is conventional in prior art thermostats, the desired temperature level *t* can be adjusted as necessary. This requires that the individual settings for the actuation of switches **14*a* and 14*b*** ($t_1$ and *t*), respectively, "track" i.e., be adjustable simultaneously, as well as with respect to each other.

Figure 4:
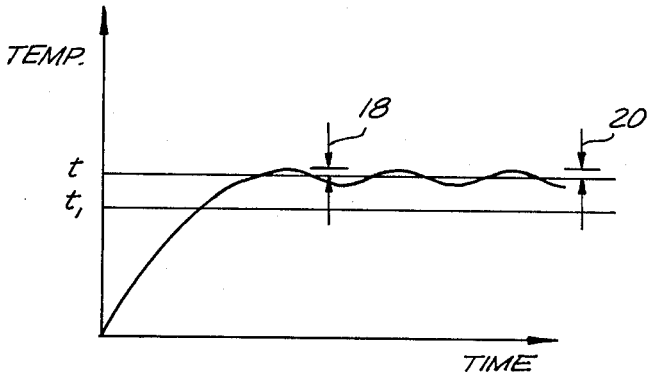
FIG. 4 is a graphical representation of the environmental temperature through time produced by the apparatus of FIG. 3.
Figure 5:
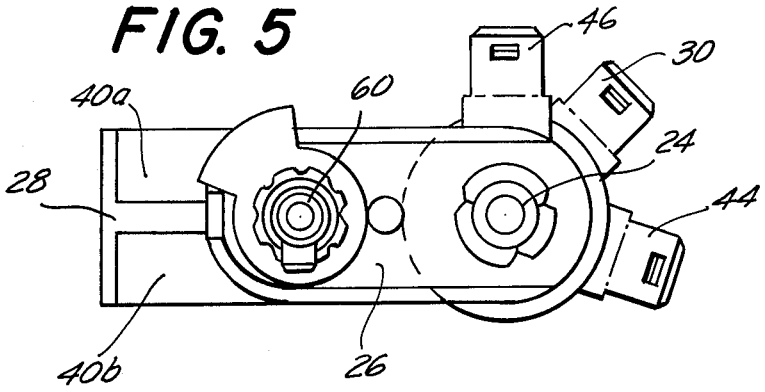
FIG. 5 is a top view of the duplex thermostat of the present invention.
Figure 6:
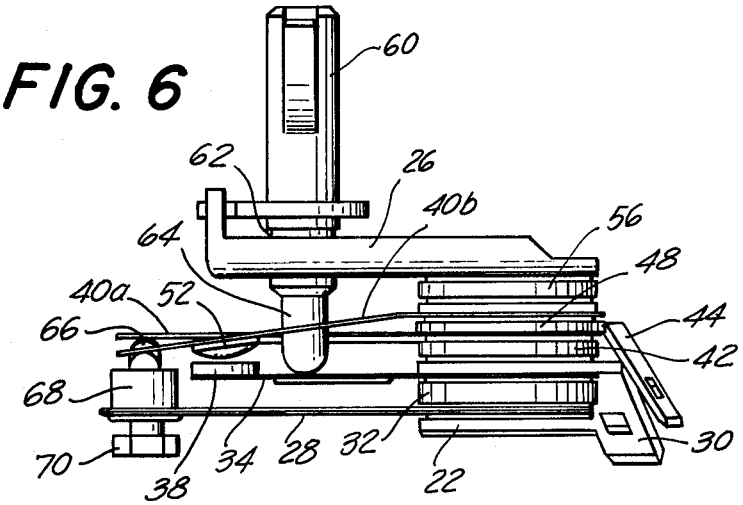
FIG. 6 is a side view of the duplex thermostat of the present invention.
Figure 7:
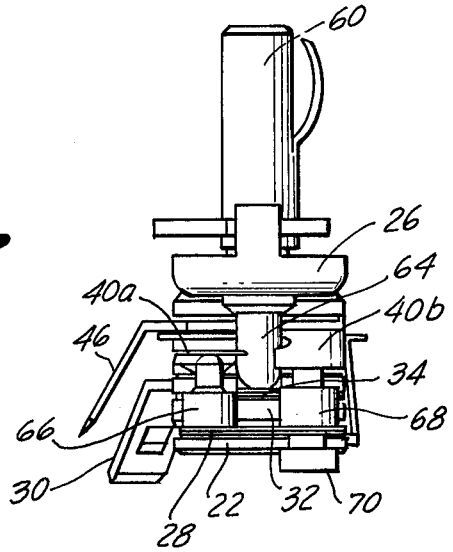
FIG. 7 is a front view of the duplex thermostat of the present invention.
Figure 8:
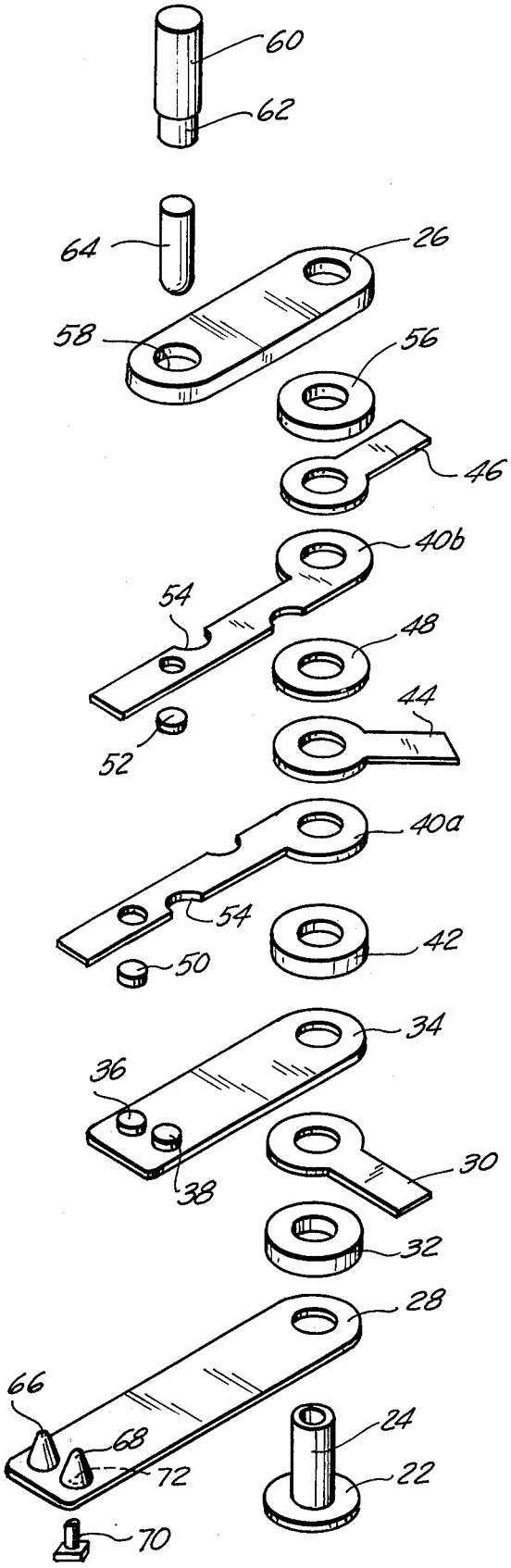
FIG. 8 is an exploded isometric view of the duplex thermostat of the present invention.

In this manner, as illustrated in FIG. 4, the magnitude of the initial overshoot 18 of environmental temperature with respect to the normal cyclical deviations of ambient temperature relative to the desired temperature level, is significantly reduced, as compared to the magnitude of overshoot, as shown in FIG. 2. Further, the amplitude *a* of the cyclical variations of the environmental temperature with respect to the desired temperature level through time, as represented by numeral 20, is also significantly reduced with respect to corresponding amplitude, as shown in FIG. 2. The effect of the apparatus of the present invention is to keep the environmental temperature at a level much closer to the desired temperature level than is possible with conventional systems. This effect both reduces the initial overshoot and the amplitude of the cyclical variations through time, thereby achieving optimum performance of the heat producing apparatus and conserving energy.

The structure of the duplex thermostat of the present invention is described below with reference to FIGS. 5–8. The thermostat includes an insulating support, preferably made of the appropriate ceramic material. The support comprises a bottom disc-like member 22 having an upstanding cylindrical member 24 mounted thereon. The various components of the thermostat are provided with apertures such that each can be mounted in cantilever fashion on cylindrical member 24. An insulating top plate 26 is affixed to the top of cylindrical member 24, thereby sandwiching the elements of the thermostat between the top plate 26 and the bottom member 22.

A thermally deformable element 28, preferably in the form of a bimetallic strip, is mounted on cylindrical member 24 adjacent member 22. A first terminal 30, designed to be operatively connected to one side of energization source 12 by means of a lead (not shown) is electrically isolated from deformable element 28 by means of a ceramic washer 32. Terminal 30 is situated adjacent to and in electrical contact with an elongated resilient member 34. Member 34 has mounted thereon, at a location spaced from the point where it is mounted on the support, a pair of contacts 36, 38. A second elongated resilient member 40 is mounted on the support above member 34 and is insulated therefrom by means of a ceramic washer 42. Resilient member 40 comprises first and second electrically isolated parts, **40*a* and 40*b*, respectively. Part 40*a* is adjacent and in electrical contact with a second terminal 44. Part 40*b* is adjacent to and in electrical contact with a third terminal 46. Terminal 44 is connected to one of the heating elements, for instance, element 10*a*, and terminal 46 is connected to the other heating element, for instance, 10*b*, by means of leads (not shown). Parts 40*a* and 40*b* are electrically isolated by means of a ceramic washer 48. Parts 40*a* and 40*b* have their elongated portions transversely offset with respect to each other such that they are situated in a side-by-side relationship and each can move in a direction parallel to the axis of cylindrical member 24 of the support independently and without interference from each other. Mounted on the elongated portion of part 40*a* is a contact 50 in alignment with contact 36 on member 34. In a similar manner, the elongated portion of part 40*b* carries a contact 52, which is in alignment with contact 38 on member 34. Further, each of the parts 40*a* and 40*b* is provided with a semicircular aperture 54 which, when aligned, form a circular opening in member 40**, the purpose of which is disclosed hereafter.

Terminal 46 is insulated from top plate 26 by means of a ceramic washer 56. The top plate 26 is elongated and provided with an internally threaded aperture 58. An adjustable shaft 60 is provided with an externally threaded portion 62 which protrudes into aperture 58 in top plate 26. A downwardly extending projection 64 made of insulating material is mounted to the bottom of shaft 60 and protrudes through the circular opening formed of aperture 54 in member 40 so as to engage the mid-section of member 34 at a location between the contacts 36 and 38, on the one hand, and the support, on the other hand. In this manner, protrusion 64 engages member 34 without interference from member 40. The rotation of shaft 60 with respect to top plate 26 serves to move projection 64 upwards or downwards to deform member 34, thereby adjusting the distance between member 34 and member 40. Shaft 60 is provided with a knob (not shown) to facilitate rotation thereof. The rotation of shaft 30 sets the desired temperature level $t$ at which the environmental temperature is to be maintained.

It should be noted that deformable element 28 is approximately equal in length to member 40, i.e., parts **40*a* and 40*b*, whereas member 34 is substantially shorter than element 28 or member 40. Element 28 has mounted thereon a pair of abutments 66, 68 situated near the end thereof such that abutment 66 engages part 40*a* and abutment 68 engages part 40*b*. However, abutments 66 and 68 do not engage member 34, due to the length of element 28. Abutments 66 and 68 are of different sizes, such that the spacing between contact 50 on part 40*a* and contact 36 on member 34, on the one hand, is different from the spacing between contact 52 on part 40*b* and contact 38 on member 34. In this manner, it will require different degrees of deformation of element 28 to open contacts 36 and 50, than it will to open contacts 38 and 52. As shown herein, contacts 50 and 38 represent the contacts of switch 14*a*, whereas contacts 52 and 36 represent the contacts of switch 14*b*. It is preferable to design the device such that one or both of the abutments 66 and 68 are position adjustable with respect to element 28. In the embodiment shown herein, it is abutment 68 which is made position adjustable by means of an externally threaded trim screw 70, which is insertable into an internally threaded aperture 72 in element 28. Abutment 68 is mounted on the end of trim screw 70, such that the rotation of trim screw 70 causes the displacement of abutment 68 with respect to the surface of element 28. In this manner, the distance between contact 52 on part 40*b* and contact 38 on member 34 can be adjusted so as to regulate the relative degrees of deformation of element 28 required to close switches 14*a* and 14*b*** and thus, the difference $\Delta t$ between $t$ and $t_1$.

The above-described confirguaration permits switch **14*a* (contacts 50 and 36) and switch 14*b* (contacts 52 and 38) to be closeable at different temperatures. However, since the rotation of shaft 60 acts only on member 34, the relative spacing between the corresponding sets of contacts are effected equally by the rotation of shaft 60, such that the desired temperature level $t$ may be set. Further, since abutment 68 is position adjustable, this permits adjustment of $t_1$, and thus the difference $\Delta t$ between temperatures at which the respective switch contacts will close, without affecting the desired temperature level setting. Therefore, one of the heating elements, for example, element 10*a*, can be utilized for the initial heating operation and to compensate for gross deviations in temperature, whereas a secondary heating element 10*b* of smaller size can be utilized to maintain the temperature at the desired level. Since the secondary heating element 10*b* is somewhat smaller than the primary heating element 10*a***, the amplitude of the cyclical variations of environmental temperature around the desired temperature level setting, can be significantly reduced, thereby increasing the efficiency of the heat producing device and conserving energy.

The preferred embodiment thermostat of the present invention is illustrated herein as having two individual sets of switch contacts connectable to energize two independently actuatable heating elements. However, it should be understood that additional sets of contacts and additional heating elements may be added to the system as required. Thus, the thermostat of the present invention may be provided with $n$ different sets of contacts. Of course, for each set of contacts to be added, an additional isolated part of the first resilient member and an additional position adjustable abutment on the deformation element are required. In this manner, the desired temperature level $t$ can be set and the individual actuation temperatures $t_1, t_2 \ldots t_n$ for the $n$ heating elements can also be set. However, the differences between the desired temperature level and the actuation temperatures, $\Delta t_1, \Delta t_2 \ldots \Delta t_n$ will "track" i.e., remain unchanged as the desired temperature level $t$ is adjusted. Thus, while the preferred embodiment illustrates a thermostat with two contact sets, the present invention should not be construed being limited to a specific number of contact sets.

While only a single embodiment of the present invention has been disclosed herein for purposes of illustration, it is obvious that many variations and modifications could be made thereto. It is intended to cover all of these variations and modifications which fall within the scope of the present invention as defined by the annexed claims.

I claim:

1. A thermostat comprising a support, first and second resilient means mounted in spaced relation on said support, each of said means having mounted thereon a pair of contacts, each of said contacts on one of said means being aligned with a different contact on the other of said means, a thermally deformable element mounted on said support and spaced from said first means, means operably connecting said element and said first means such that deformation of the former moves the latter relative to said second means, means for adjustably positioning said second means relative to said first means, said first means being formed of first and second isolated parts upon each of which is mounted one of said contacts, and means for spacing said first and second parts, respectively, different distances from said element.

2. The thermostat of claim 1 wherein said spacing means is carried by said element.

3. The thermostat of claim 1 wherein each of said parts comprises a separate resilient member.

4. The thermostat of claim 3 wherein said members are situated in side-by-side relation.

5. The thermostat of claim 1 wherein said position adjusting means is mounted on said support on the opposite side of said first means from said second means and extends between said parts to engage said second means.

6. The thermostat of claim 1 wherein said spacing means comprises first and second abutments mounted on said element, at least one of said abutments being adjustably mounted so as to vary the distance between the part aligned therewith and said element.

7. A thermostat comprising a support, a bimetal element mounted on said support, first, second and third resilient members mounted on said support, said first and second members each having a contact mounted thereon, said third member having a pair of contacts thereon, each of which is aligned with said contact on said first and second member, respectively, means mounted on said support for adjusting the position of said third member relative to said first and second member, and first and second connecting means operably connecting said element to said first and said second members, respectively, at least one of said first and said second means being adjustable to vary the distance between said element and said member connected to said adjustable means.

8. The thermostat of claim 7 wherein said first and second connecting means are mounted on said element.

9. The thermostat of claim 6 wherein said adjustable means comprises a position variable abutment mounted on said element.

10. The thermostat comprising a support, two sets of contacts, resilient means mounted on said support for carrying said contacts, means for jointly varying the relative position of the resilient means carrying one contact in each set relative to the resilient means carrying the other contact in each set, a bimetal element mounted on said support, means for operably connecting said element to said resilient means carrying said other contact in each set, said connecting means being adjustable to vary the distance between said element and said resilient means carrying the other contact in at least one of said sets.

* * * * *